United States Patent [19]

Mut et al.

[11] Patent Number: 4,508,169

[45] Date of Patent: Apr. 2, 1985

[54] METHOD FOR DETERMINING CONNATE WATER SATURATION AND SALINITY IN RESERVOIRS

[75] Inventors: Alan D. Mut; Harry A. Deans, both of Houston, Tex.

[73] Assignee: Exxon Production Research Co., Houston, Tex.

[21] Appl. No.: 448,867

[22] Filed: Dec. 10, 1982

[51] Int. Cl.[3] ..... E21B 49/08

[52] U.S. Cl. ..... 166/250; 73/155

[58] Field of Search ..... 166/250, 252; 73/155

[56] References Cited

U.S. PATENT DOCUMENTS

| | | | |
|---|---|---|---|
| 2,352,638 | 7/1944 | Kelton | 73/155 |
| 3,159,214 | 12/1964 | Carter | 166/252 |
| 3,332,483 | 7/1967 | Wyllie | 73/155 X |
| 3,874,451 | 4/1975 | Jones et al. | 166/252 |
| 3,929,011 | 12/1975 | Jones | 166/252 X |
| 4,090,398 | 5/1978 | Deans et al. | 166/250 X |
| 4,102,396 | 7/1978 | Ransom et al. | 166/252 |
| 4,278,128 | 7/1981 | Satter et al. | 166/250 |

OTHER PUBLICATIONS

Tomich et al., "Single-Well Tracer Method to Measure Residual Oil Saturation," *Journal of Petroleum Technology,* Feb. 1973, pp. 211-218.

Deans et al., "Single-Well Chemical Tracer Method to Measure Connate Water Saturation", AIME Paper No. SPE 4755, 1974.

Bragg et al., "In-Situ Determination of Residual Gas Saturation by Injection and Production of Brine", AIME Paper No. SPE 6047, 1976.

Mut, *In-Situ Experimental Determination of Resident Water Saturation and Brine Salinity in a Petroleum Reservoir,* Masters Thesis, Rice University, May 1982.

*Primary Examiner*—George A. Suchfield

*Attorney, Agent, or Firm*—Karen T. Burleson

[57] ABSTRACT

A method for determining both connate water saturation and salinity in an oil-bearing reservoir with a single invasive well test is disclosed. In this method, a fluid, miscible with the reservoir oil and having the ability to dissolve a limited amount of the connate water where the solubility of the water in the fluid depends on the salinity of the water, is injected into a well penetrating the reservoir. The reservoir is then produced until oil breakthrough occurs. Samples of the produced fluids are analyzed for their water content. This water content is plotted as a function of the volume of fluids produced. The resulting curve is compared to similar curves generated by mathematical simulation.

11 Claims, 16 Drawing Figures

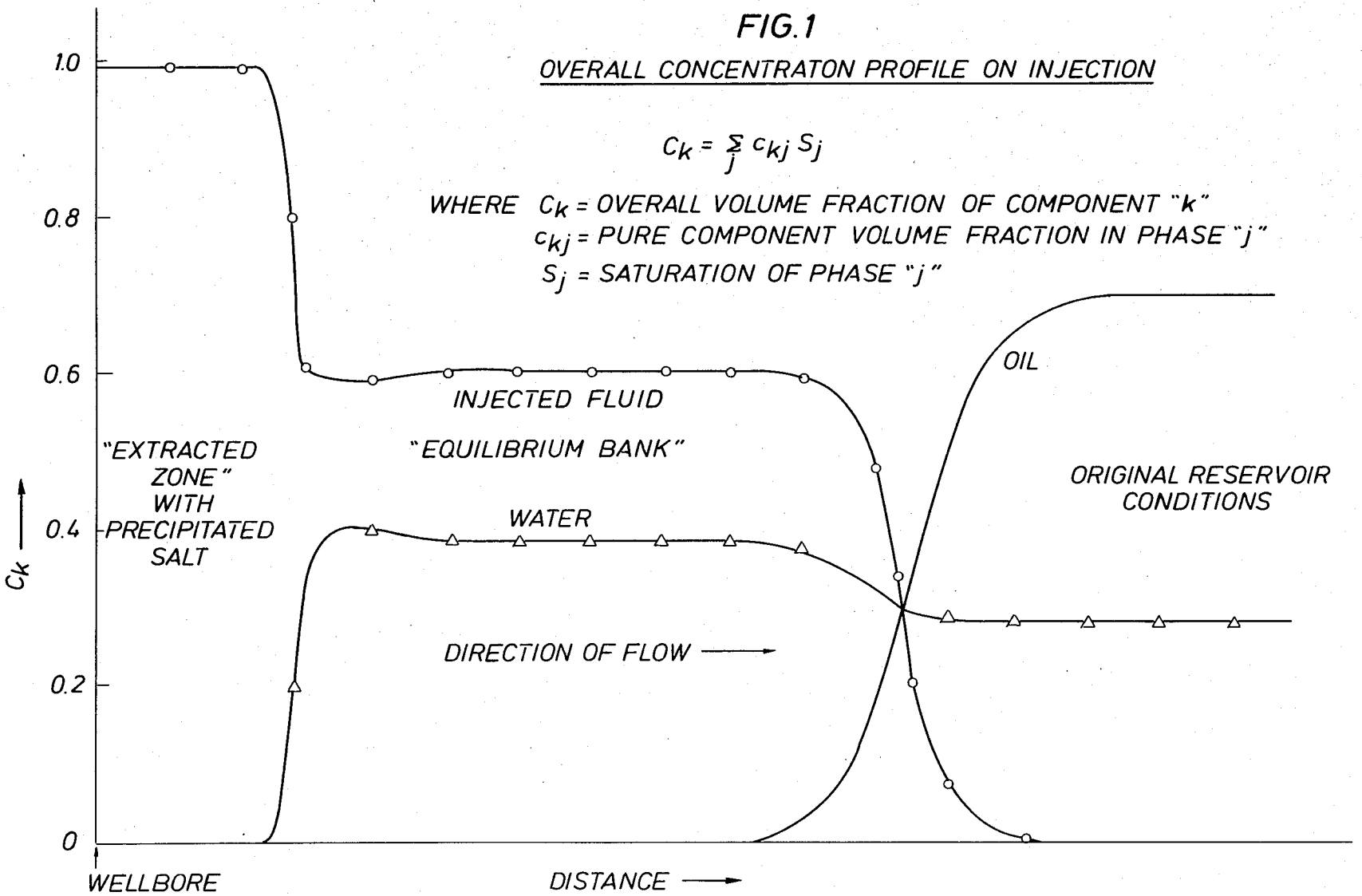
FIG. 1
OVERALL CONCENTRATON PROFILE ON INJECTION
$C_k = \sum_j c_{kj} S_j$
WHERE $C_k$ = OVERALL VOLUME FRACTION OF COMPONENT "k"
$c_{kj}$ = PURE COMPONENT VOLUME FRACTION IN PHASE "j"
$S_j$ = SATURATION OF PHASE "j"
OIL
ORIGINAL RESERVOIR CONDITIONS
INJECTED FLUID
"EQUILIBRIUM BANK"
WATER
DIRECTION OF FLOW
"EXTRACTED ZONE" WITH PRECIPITATED SALT
1.0
0.8
0.6
0.4
0.2
0
$C_k$
DISTANCE
WELLBORE

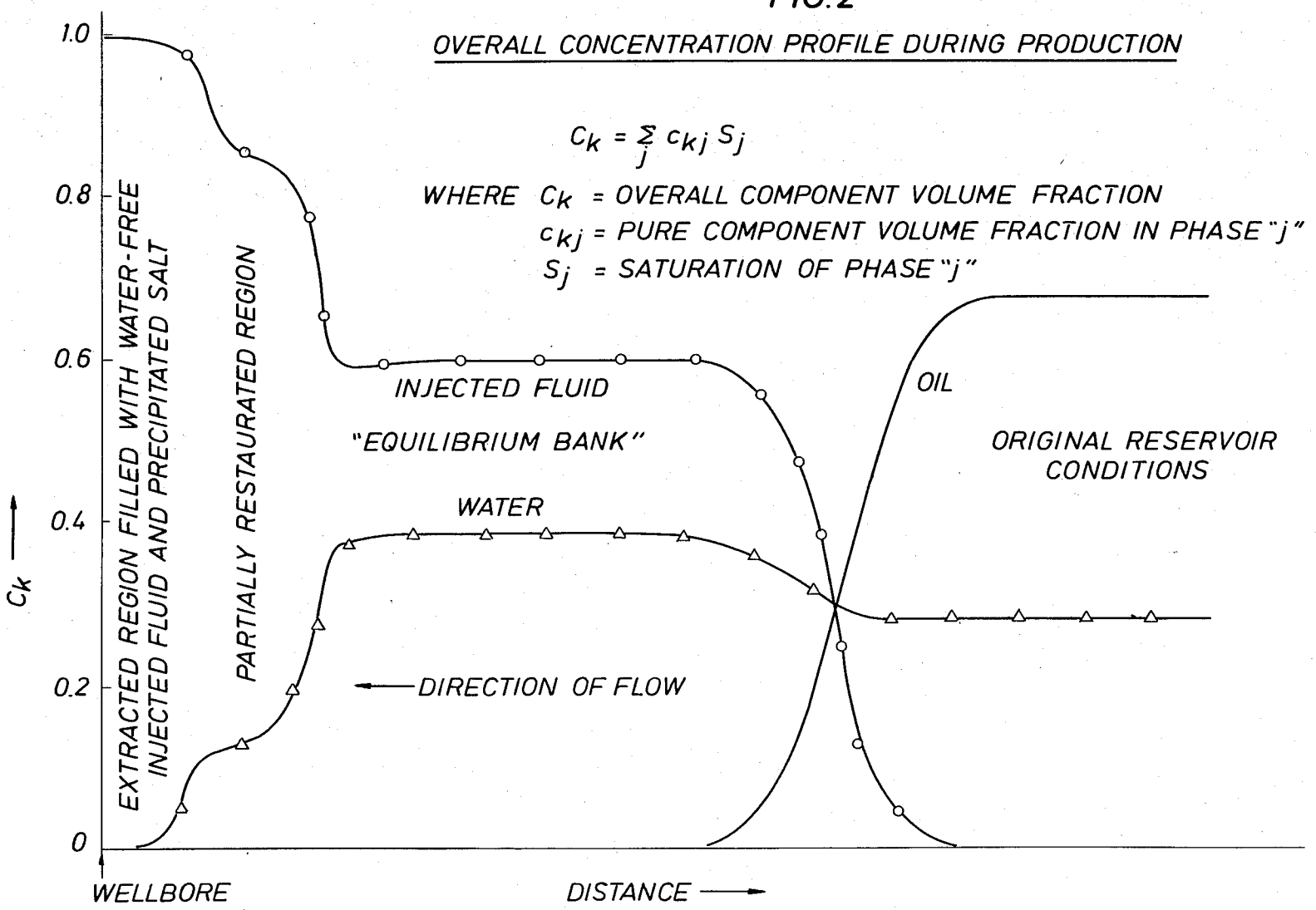
FIG. 2
OVERALL CONCENTRATION PROFILE DURING PRODUCTION
$C_k = \sum_j c_{kj} S_j$
WHERE $C_k$ = OVERALL COMPONENT VOLUME FRACTION
$c_{kj}$ = PURE COMPONENT VOLUME FRACTION IN PHASE "j"
$S_j$ = SATURATION OF PHASE "j"
OIL
ORIGINAL RESERVOIR CONDITIONS
INJECTED FLUID
"EQUILIBRIUM BANK"
WATER
DIRECTION OF FLOW
PARTIALLY RESTAURATED REGION
EXTRACTED REGION FILLED WITH WATER-FREE INJECTED FLUID AND PRECIPITATED SALT
WELLBORE
DISTANCE
$C_k$
1.0
0.8
0.6
0.4
0.2
0

FIG. 5 EFFECT OF INITIAL SALINITY ON PRODUCTION BEHAVIOR $S_{cw}$ = 20%
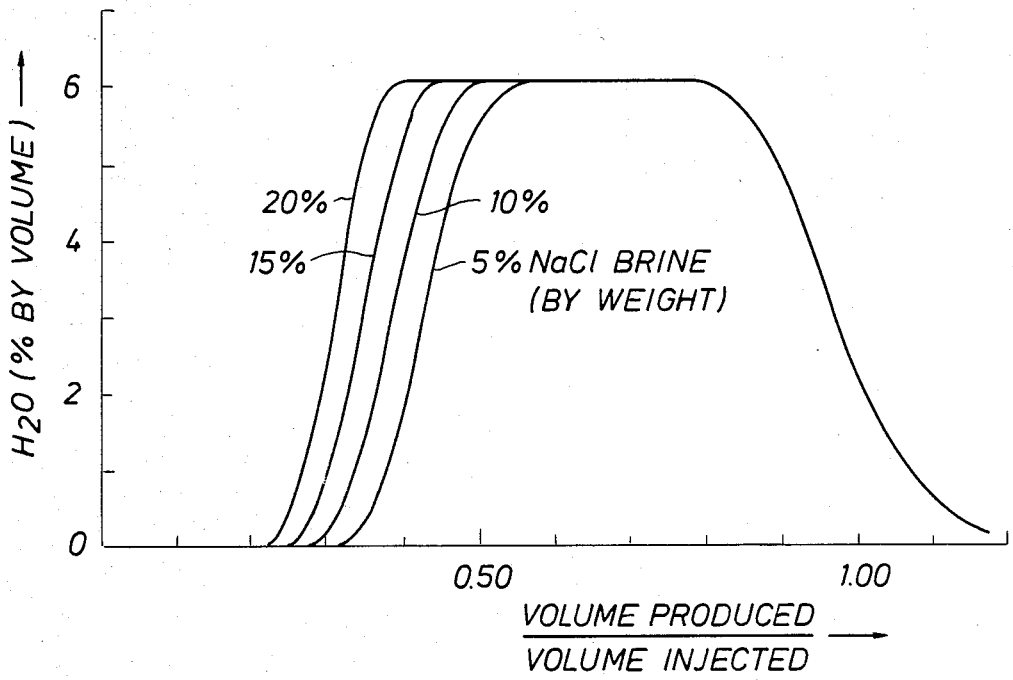
FIG. 6 EFFECT OF INITIAL WATER SATURATION ON PRODUCTION BEHAVIOR 10% NaCl BRINE
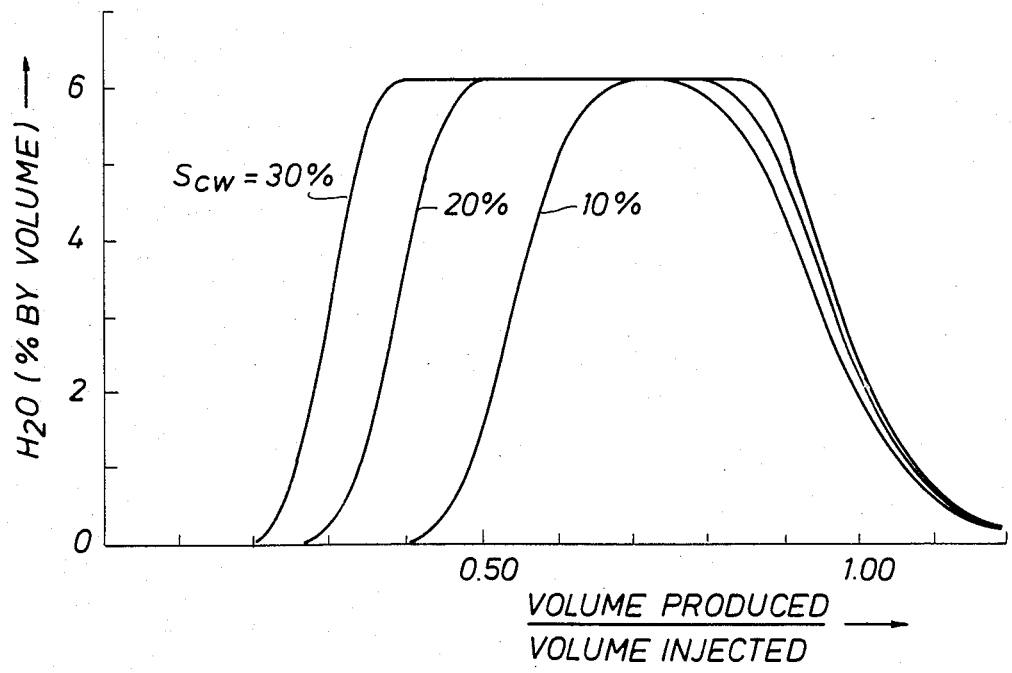

EFFECT OF INITIAL WATER SATURATION ON WATER PRODUCTION HISTORY
LOW SALINITY CASE
2.5% NaCl BRINE $H_2O$ (% BY VOLUME)
0
2
4
6
8
10
12
$S_{cw}$ = 30%
22%
15%
0.50
1.00
VOLUME PRODUCED / VOLUME INJECTED

EFFECT OF BRINE SALINITY ON WATER PRODUCTION HISTORY
LOW SALINITY CASE
$S_{cw}$ = 30%

$H_2O$ (% BY VOLUME)
0
2
4
6
8
10
12
1%
2%
3%
4%
0.50
1.00
VOLUME PRODUCED / VOLUME INJECTED

CORE NO. 1
$(S_w)_o$ = 0.264
(NaCl) = 1.5% BY WEIGHT 12
8
4
0
$H_2O$ (% BY VOLUME)
PREDICTED BY SIMULATION
EXPERIMENT
0.5
1.0
$V_{PROD.}/V_{INJ.}$

CORE NO. 2
$(S_w)_o$ = 0.266
(NaCl) = 2.5% BY WEIGHT 12
8
4
0
$H_2O$ (% BY VOLUME)
PREDICTED BY SIMULATION
EXPERIMENT
0.5
1.0
$V_{PROD.}/V_{INJ.}$

CORE NO. 3
$(S_W)_O$ = 0.24
(NaCl) = 10% BY WEIGHT
PREDICTED BY SIMULATION
EXPERIMENT
$H_2O$ (% BY VOLUME)
12
8
4
0
0.5
1.0
$V_{PROD.}/V_{INJ.}$

NaCl (% BY WEIGHT) IN RESERVOIR BRINE
25
20
15
10
5
0
WELL NO. 1
MATERIAL A
WELL NO. 2
MATERIAL B
0
10
20
30
WATER SATURATION (%)

METHOD FOR DETERMINING CONNATE WATER SATURATION AND SALINITY IN RESERVOIRS

BACKGROUND OF THE INVENTION

This invention relates to a method for determining resident water saturation and/or salinity in an oil-bearing reservoir at connate water saturation conditions. More specifically, this invention relates to such a method wherein a wellbore penetrating said reservoir is used and samples of produced fluids are taken therefrom.

BRIEF DESCRIPTION OF THE PRIOR ART

Knowledge of the fluid saturations existing in an oil-bearing reservoir is essential for efficient recovery of the oil. A number of methods are now available for determining such fluid saturations.

Coring is one such method. In coring, a small segment of the reservoir rock saturated with fluids is cored from the reservoir and removed to the earth's surface where its fluid saturation can be analyzed. This method, however, has a number of limitations. It is susceptible to the faults of the sampling technique; a sample taken may or may not be representative of the reservoir as a whole. It can only be employed in newly drilled wells or open hole completions. In the vast majority of wells, casing is set through the oil-bearing formation when the well is initially completed. Core samples cannot, therefore, subsequently be obtained from such a well. By its very nature, coring only investigates the properties of the reservoir rock and fluids in the immediate vicinity of the wellbore. The coring process itself may change the fluid saturation of the extracted core.

Another method for obtaining reservoir fluid saturations is the use of logging techniques. These techniques study the rock-fluid system as an entity. It is often difficult with logging techniques, however, to differentiate between the properties of the rock and its fluid. Log-inject-log techniques have been recently developed in an attempt to overcome this differentiation problem. But special care must be taken when applying log-inject-log techniques to avoid inducing changes in the near-wellbore fluid properties. Most logging techniques require knowledge of the reservoir brine salinity and rock porosity. Logging techniques also investigate reservoir rock and fluid properties for only a short distance beyond the wellbore.

More recent methods for determining fluid saturations in a reservoir ar concerned with injection and production of trace chemicals into and out of the reservoir. For example, as proposed in U.S. Pat. No. 3,590,932 issued July 6, 1971 to C. E. Cooke, Jr., a carrier fluid containing at least two tracers having different partition coefficients between the immobile fluid and the aqueous fluid containing the tracers is injected into one location in the reservoir and produced from another. Due to the different partition coefficients of the tracers, they will be chromatographically separated as they pass through the reservoir, and this chromatographic separation is a function of the saturation of the immobile fluid phase. In another example, as suggested in U.S. Pat. No. 3,623,842 issued Nov. 30, 1971 to H. A. Deans, a carrier fluid containing a reactive chemical substance is injected into the reservoir through a well. The carrier fluid reactant solution is displaced into the reservoir and the well is shut-in to permit the reactant to undergo a chemical change to produce additional tracer materials having different partition coefficients. When the well is produced, the tracers having different partition coefficients are chromatographically separated, and the degree of separation may be used to determine the residual fluid saturation in the reservoir. Tracer partitioning coefficients are dependent on the salinity of the reservoir brine, in addition to the reservoir temperature, pressure and oil composition. The brine salinity must therefore be known with these methods as well, or a brine sample must be available for experimental equilibrium determinations so that the test data can be properly analyzed.

It is particularly difficult to determine accurately brine salinity in a reservoir that has little, if any, water production, in other words, a reservoir at connate water saturation conditions. A primary technique for determining such salinity is coring, using oil-base mud, but this method still has the problems mentioned above with coring to determine reservoir fluid saturations.

A method for determining reservoir fluid saturations not requiring knowledge of salinity was suggested in U.S. Pat. No. 4,090,398 issued May 23, 1978 to H. A. Deans et al. That method proposed that the fluid saturations of an immobile fluid phase and at least one mobile fluid phase could be determined in a reservoir containing such phases by injecting into the reservoir a measured volume of fluid unsaturated with the immobile fluid and having limited solubility for the immobile fluid. In that method, such injected fluid is injected in an amount such that a portion of it remains unsaturated with the immobile fluid phase in the reservoir. As the injected fluid flows radially away from the wellbore, it dissolves immobile fluid and reduces the immobile fluid saturation. The flow is reversed and the injected fluid is produced through the injection well in an amount sufficient to determine the volume of injected fluid substantially unsaturated with immobile fluid. The concentration of the immobile fluid dissoved in the produced fluid and the produced fluid volume are measured. By applying material balance principles to this concentration and the injected and produced fluid volumes, the relative proportions of the immobile and mobile fluids in the reservoir may be determined. This method has the advantage, as do the tracer methods discussed above, of allowing investigation of the reservoir fluid properties some distance beyond the immediate wellbore area.

However, this method necessarily assumes that the immobile fluid concentration profile in the injected liquid at the end of the injection cycle remains substantially the same as the injected liquid is produced and that the apparent saturation of the immobile fluid is proportional to said concentration as related by a volumetric balance. These assumptions are appropriate when the immobile fluid is a gas or fresh water. When such immobile fluid is brine, or when the reservoir otherwise contains salt, however, the method does not account for the effects of the salt, which are significant, on the effluent fluid concentration profile. Most oil-bearing reservoirs contain brine or salt, rather than fresh, water. Hence, this prior art method has limited utility in reservoirs at connate water saturation conditions, where the salinity of the connate water is not easily determined and the connate water is likely to contain some salt.

SUMMARY OF THE INVENTION

The present invention provides a method for determining connate water saturation in an oil-bearing reservoir at connate water conditions by a single well test. This method is specifically for reservoirs where such connate water contains salt—is brine rather than fresh water. For convenience, reservoir connate water will therefore also be referred to interchangeably herein as "water," "resident water" or "brine," as is common practice in the art. This method has the advantage of an in-situ method which allows investigation of the reservoir connate water saturation some distance beyond the immediate wellbore area. Its application is not dependent on knowledge of reservoir properties such as brine salinity and rock porosity.

In addition, the salinity of the reservoir brine can be determined with the present single well test. This knowledge of reservoir brine salinity is needed to determine certain other reservoir fluid properties by certain logging techniques and tracer methods Knowledge of reservoir salinity is also important in planning enhanced oil recovery projects using polymers or surfactants.

According to the present invention, reservoir connate water saturation and salinity may be determined by: (1) injecting a known volume of fluid into the reservoir, the fluid being miscible with the oil in the reservoir and having the ability to dissolve a limited amount of the water, the solubility of the water in the fluid being dependent on the salinity of the water; (2) producing the reservoir through the same well as that used for injection while taking sample of the fluids until oil breakthrough occurs; (3) analyzing the water content of the samples; (4) plotting the data from the analysis as a function of the volume of fluids produced, where such plot will show a hump-type deviation from a plateau-type water peak; and (5) comparing said plot to "type" curves wherein the saturation and salinity have set values, and selecting as the reservoir values the set values of the particular type curve which substantially matches the experimental plot. The type curves may be generated using known mathematical techniques of analysis and hand plotted, or they may be computer generated.

The nature and objects of the invention can best be understood by referring to the following detailed description and the accompanying drawings.

BRIEF DESCRIPTION OF THE DRAWINGS

FIG. 1 is a typical fluid concentration profile for a reservoir at connate water saturation conditions upon injection of a fluid miscible with the reservoir oil and having the ability to dissolve a limited amount of reservoir brine.

FIG. 2 is a typical reservoir fluid concentration profile for a reservoir at connate water saturation conditions during production of reservoir fluids following injection of a fluid miscible with the reservoir oil and having the ability to dissolve a limited amount of reservoir brine.

FIG. 5 is a plot demonstrating that the higher the reservoir brine salinity, the sooner water production occurs.

FIG. 6 is a plot demonstrating that water production is earlier for reservoirs with higher connate water saturations in high salinity reservoirs.

DESCRIPTION OF THE PREFERRED EMBODIMENT

Figure 3:
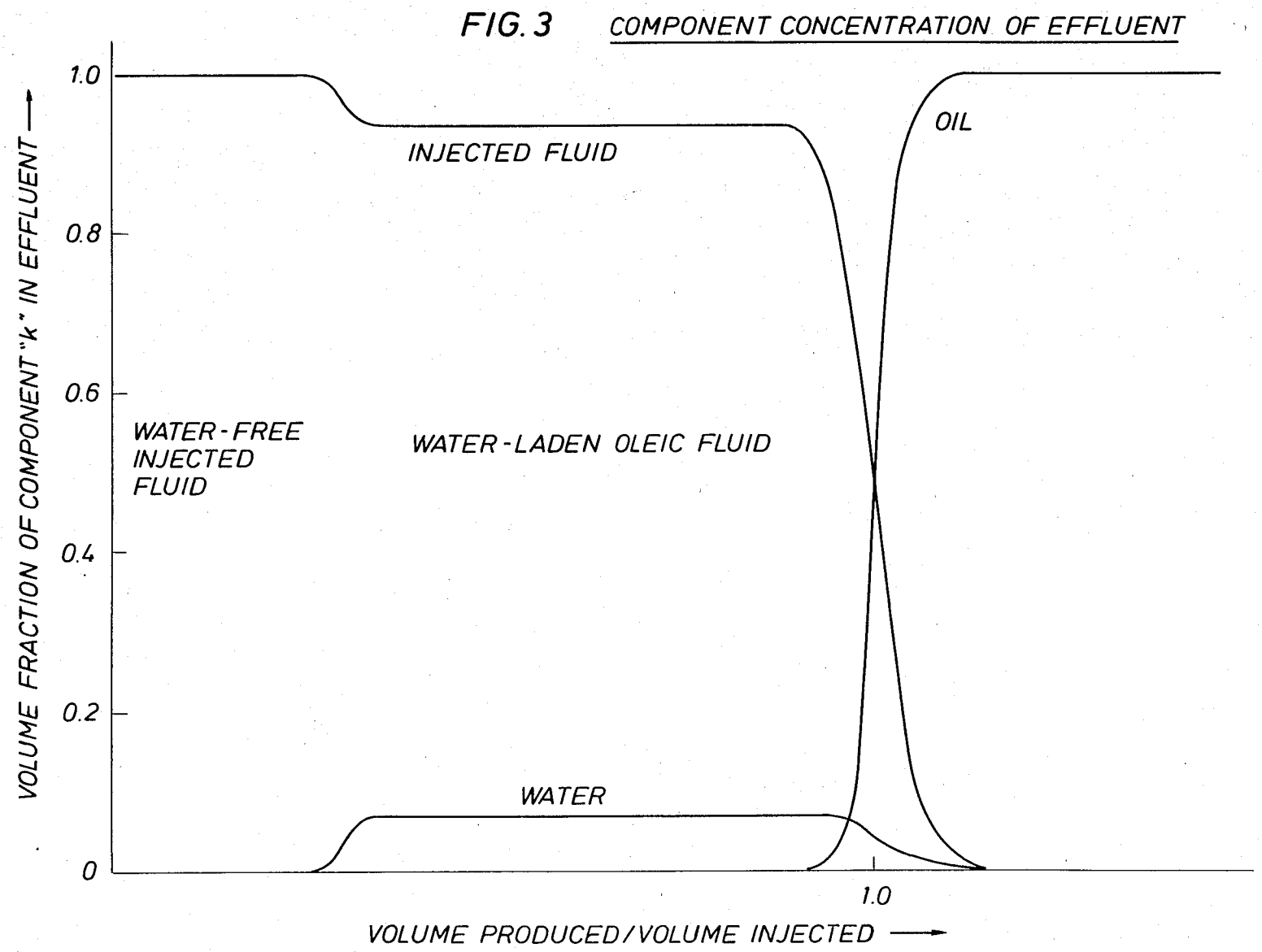
FIG. 3 is a plot showing an example of the production history for a test giving a fluid concentration profile like that in FIG. 2.

In the preferred practice of this invention, both connate water saturation and salinity in an oil-bearing reservoir may be determined with a single invasive well test. The test uses the irreversible flowing phase behavior effects of a push-pull chemical extraction.

The subject reservoir should be one where flow can be mathematically described. The best example of such a reservoir is a thin reservoir, less than 30 feet thick, which is fairly homogeneous with no evident faults or fractures. However, any reservoir whose flow can be simulated may be successfully tested.

The part of the reservoir to be tested must be at or near (less than 1% water production) connate water saturation conditions. Preferably, oil and connate water or brine will be the only fluids in the test area of the reservoir and no gas will be present. The test area of the reservoir will be that area extending radially from a wellbore penetrating the reservoir and used in the test. The test area may extend several feet or more into the reservoir, basically as far as is economically feasible.

For the test, a fluid, usually an oleic fluid, such as an alcohol, is selected. The fluid must be miscible with, and preferably have a viscosity similar to that of, the oil in the test area of the reservoir. The fluid must also have the ability to dissolve a limited amount of water, i.e., the fluid must be partially but not totally miscible with water, and the solubility of water in the fluid must depend on the salinity of the water. We have found that the more water the fluid will dissolve, the more sensitive the test will be to brine salinity, but the less sensitive the test will be to water saturation. Preferably, the solubility of pure water in the fluid will be less than 50%.

In conducting the test, a known volume of the fluid is injected into the reservoir. Such volume should be at least large enough to completely extract the connate water in the reservoir area immediately adjacent to the wellbore. Such area will vary with the particular reservoir, but should preferably extend at least three feet radially from the wellbore. Thus, for example, a minimum of about 20 barrels of injected fluid might be used for a five foot vertical test interval to completely extract three radial feet from the wellbore. A more typical injection volume, however, is 50 barrels of injected fluid per vertical foot of test interval. The injection rate should preferably be such that the flow rate in the reservoir will be slow, allowing time for the injected fluid to each equilibrium with the connate water in the reservoir and minimizing the amount of hydrodynamic mixing or dispersion occurring in the reservoir. Rates in excess of those fracturing the reservoir will obviously need to be avoided. While appropriate rates will depend on the reservoir characteristics, generally about 50 barrels of fluid injected per day per vertical foot of reservoir test interval will be typical. Thus, for a twenty foot interval, an injection rate of 1000 barrels of fluid per day might typically be used.

As injection begins, said fluid will preferentially extract water from the connate water around the wellbore. As injection of said fluid continues, more connate water will be dissolved causing salt precipitation from the connate water. Ultimately, the region of the reservoir near the wellbore will be completely dehydrated or extracted ("the extracted zone"). The water removed from the extracted zone is contained in a mobile "equilibrium bank" in which the water-laden injected fluid will exist in equilibrium with the connate water in the reservoir. The size of this "equilibrium bank" will grow proportionately with the size of the extracted zone, which in turn will grow proportionately with the amount of said fluid injected into the reservoir. The water-laden injection fluid serves to displace the reservoir oil in a radial direction away from the wellbore. Typical concentration profiles in the reservoir on this inflow of the injected fluid are represented in FIG. 1.

After the known amount of said fluid has been injected into the reservoir, the same well is produced until oil breakthrough is complete. Samples of the fluids being produced from the wellbore are taken during such production. Sampling should begin with production, continue periodically throughout production and cease when water production ceases. Preferably, one sample will be taken for about every 1 percent of fluid injected. For example, if 50 barrels of the injection fluid are injected per foot during a one day injection period into a 20 foot thick reservoir interval, a sample should be taken approximately once for every 10 barrels of fluids produced. The production flowrate can be the same as the injection rate for convenience, but this is not necessary. As in the case of injection, the production flowrate in the formation should preferably be slow, allowing time for the injected fluid to reach equilibrium with the water and salt remaining in the reservoir and minimizing the amount of hydrodynamic mixing or dispersion occurring in the reservoir.

We have discovered that reversal of the flow in the reservoir for this production does not lead to a reversible resaturation of the extracted zone. FIG. 2 shows typical concentration profiles which develop in the reservoir during such production. A comparison of FIG. 2 with FIG. 1 shows how the profiles for inflow and production may differ.

Produced first is any water-free injected fluid occupying the extracted zone. Such fluid is the last injected into the reservoir after the area around the wellbore has become extracted by previously injected fluid.

Next produced is the water-laden injected fluid from the "equilibrium bank". For production, said injected fluid will flow back over the precipitated salt in the extracted zone to reach the well. Salt diminishes the ability of the injected fluid to hold water, and hence, we have discovered that contact with the salt causes some of the water previously dissolved in the injected fluid to drop out of the injected fluid. We have observed that this water which drops out of the injected fluid will not flow because of the low water saturations in the region. Since the injected fluid can hold a limited amount of water, even when in contact with a salt precipitate, the injected fluid will not lose all of the water earlier dissolved in it in this extracted zone resaturation process. The still dissolved water will be produced in the injected fluid until oil breakthrough is complete. The oil breakthrough time is dependent only on the volume of fluid injected into the reservoir.

A typical example of the production history for such a test is depicted in FIG. 3.

The samples of the fluids produced from the wellbore taken during production are analyzed for their water content. Such analysis may be by any of a number of methods known to those skilled in the art. The resulting information is plotted, concentration of water vs. volume of fluids produced. This plot will resemble one of the typical examples shown in FIG. 4. If the plot is similar to plot a or b in FIG. 4, it is then compared to curves generated by mathematical simulation for the reservoir to determine the reservoir connate water saturation and/or salinity. The connate water saturation and salinity of the tested reservoir will be the same as the values for such saturation and salinity used in the simulation that generated the matching curve.

Figure 4:
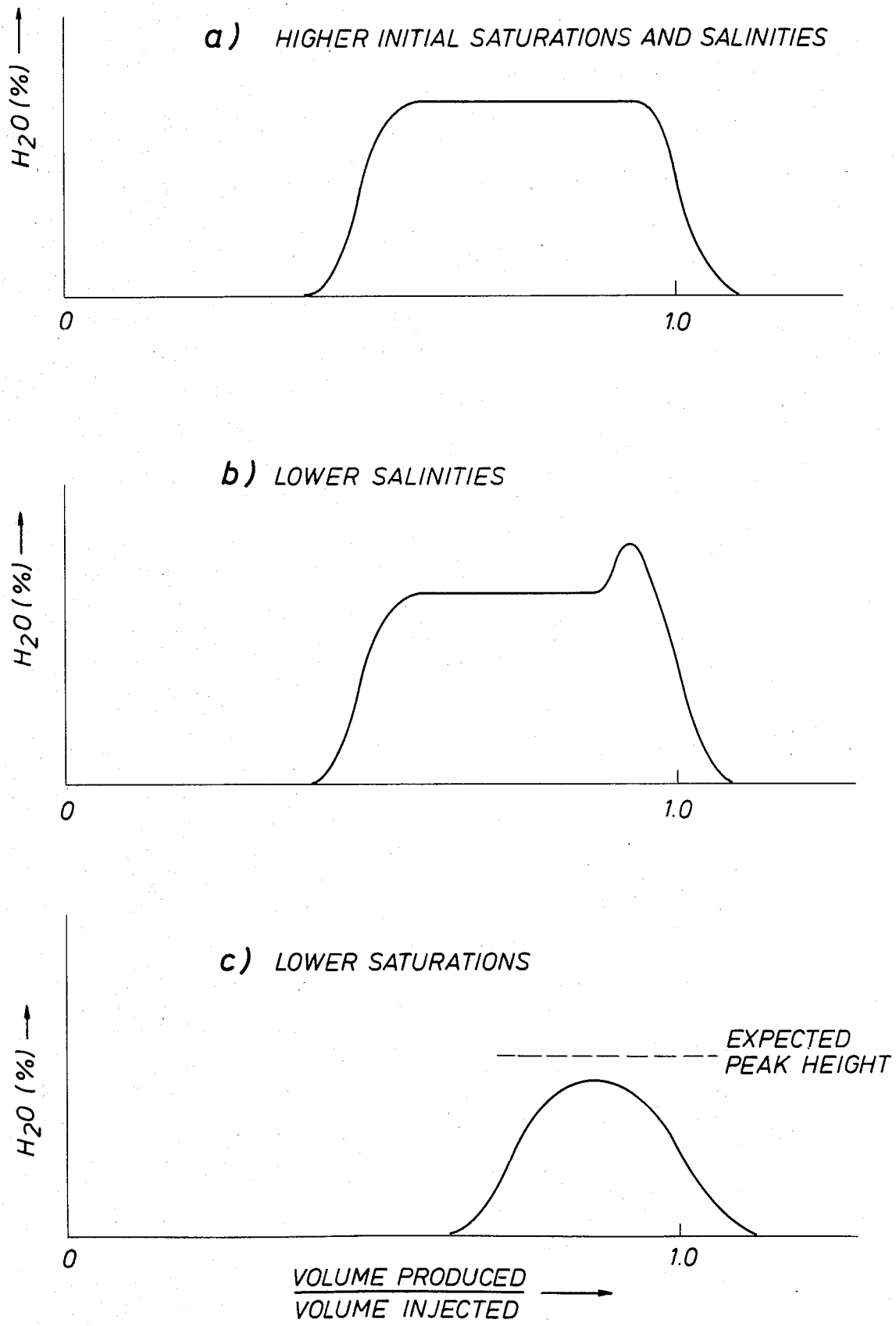
FIG. 4 is a group of three plots indicating the three distinct types of test production behavior that can result from the application of this invention.

A test plot like Plot b in FIG. 4 is prefered. With it, both reservoir connate water saturation and salinity may be determined. This result is achieved in low salinity cases. From Plot a in FIG. 4, reservoir connate water saturation may be determined if the salinity of the connate water is known, or the reservoir connate water salinity may be determined if the connate water saturation is known, but neither the reservoir connate water saturation nor salinity may be determined if both are unknown. This result is obtained in high salinity cases. What is considered a low or high salinity for this purpose will vary with the equilibrium behavior of the particular fluid injected with respect to the reservoir oil and brine. For example, for the theoretical system n-butanol (as injected fluid), diesel oil (as reservoir oil) and water containing sodium chloride (as reservoir brine), low salinity cases are those in which there is less than 5% by weight sodium chloride in the water. Such cases will hereinafter be referred to as high or low salinity cases with this reference being understood to mean relative to the equilibrium behavior of the oil, brine, and injected fluid system.

High Salinity Cases

In higher salinity cases, the water content of the produced fluids as a function of the ratio of volume of fluids produced over volume of injected fluid injected can be represented by a flat-topped peak as seen in Plot a in FIG. 4. This plateau behavior is seen because the extracted zone near the wellbore is not completely resaturated to the point where all of the salt precipitate is redissolved. The peak water concentration observed is that of the injected fluid in contact with salt precipitate and salt-saturated brine. The arrival time of this water peak is dependent on the volume of the extracted zone. Said volume is affected by the reservoir connate water saturation and salinity as well as the amount of fluid injected into the reservoir. These effects will be discussed below. The trailing end of the peak indicates the point at which oil breakthrough occurs. The arrival time of the oil breakthrough is dependent on the volume of fluid injected.

For reservoirs identical in all respects except reservoir brine salinity, a given volume of injected fluid will absorb a smaller amount of water in the reservoirs with higher brine salinity. Consequently, a smaller volume of the reservoirs will become completely dehydrated or extracted during the injection process. This results in an earlier arrival time of the water production for higher salinity reservoirs. FIG. 5 demonstrates this phenomenon for four cases with high salinity. It depicts the theoretical plots of four tests in theoretical reservoirs varying only in the degree of their brine salinity. The reservoirs originally contained brine and a light diesel oil. The injected material was n-butanol in each test. The reservoir temperature and pressure were 25° C. and 1 Atm. respectively.

For reservoirs identical in all respects except degree of connate water saturation, a given amount of injected fluid will absorb the same amount of water. However, since the water is distributed in different ways, a smaller volume of the reservoir will be extracted (to a water-free state) in a reservoir with a higher connate water saturation. As such, the extracted zone volume will be smaller. Consequently, the observed arrival time of the water peak will be sooner for reservoirs with a higher connate water saturation. This behavior is demonstrated in FIG. 6. FIG. 6 depicts the theoretical plots of three tests in theoretical reservoirs varying only in their connate water saturation. The reservoirs initially contained high salinity brine and diesel oil. The injected fluid was n-butanol. The temperature and pressure in each reservoir was 25° C. and 1 Atm. respectively.

Hence, in the cases where the plateau production profile is observed, that is, when higher salinity brines are present, both connate water saturation and connate water or brine salinity have similar effects on the arrival time of the water peak. Therefore, the value of one is needed before the value of the other may be determined.

Low Salinity Cases

In lower salinity cases, a sufficient amount of water is dissolved in the water-laden injected fluid passing through the extracted zone during production to drop out and redissolve all of the precipitated salt in that zone. As portions of the zone are resaturated beyond the point of salt saturation, the brine salinities in the connate water present decrease below saturation. As a result, the injected fluid flowing through this once extracted but now partially resaturated zone can hold more water than the salt saturation limit. When all of the salt is finally redissolved in the once extracted zone immediately surrounding the wellbore, a hump-type deviation from the plateau production behavior occurs. Hence, both reservoir connate water saturation and salinity may be determined. This hump-type deviation behavior is demonstrated in Plot b of FIG. 4. The lower the salinity is in such cases, the larger the hump-type deviation and the earlier it occurs because there is less salt to be redissolved and more water dissolved and available in the injected fluid.

Figure 7:
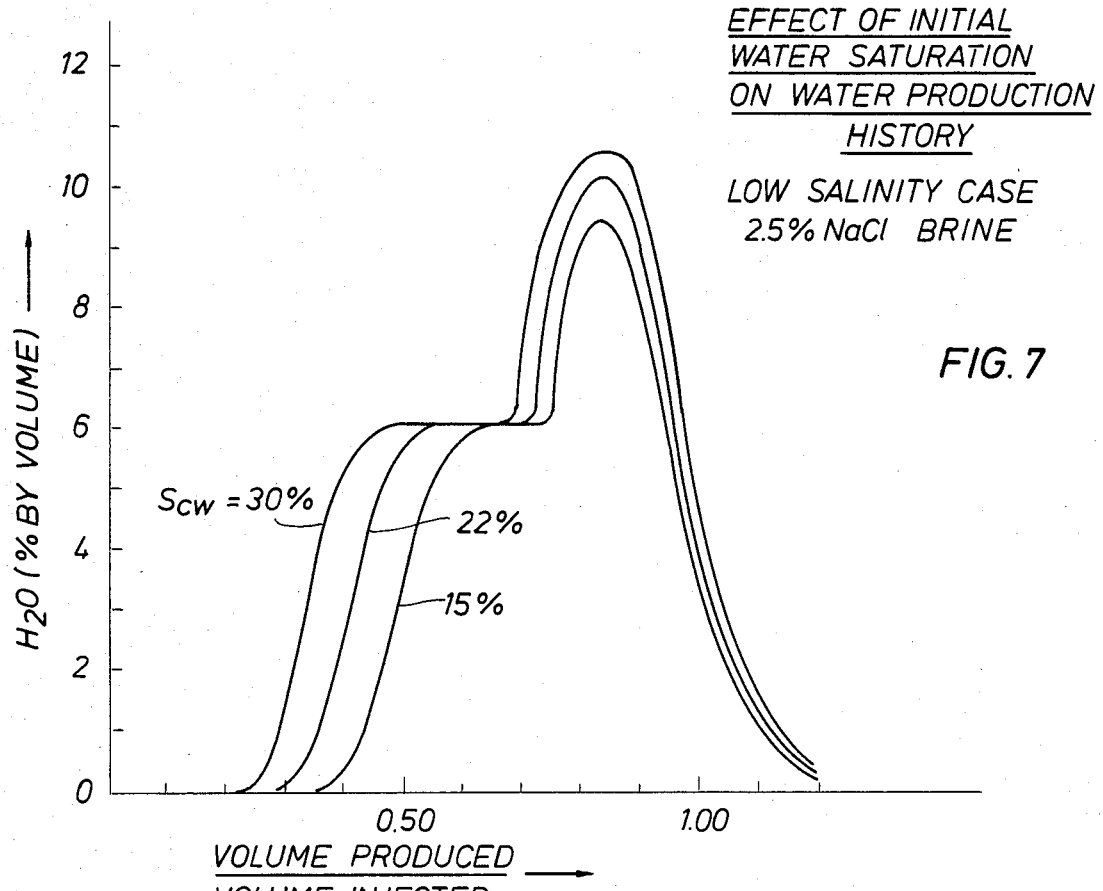
FIG. 7 is a plot showing the effect the degree of connate water saturation in a reservoir with low salinity brine has on water production.
Figure 8:
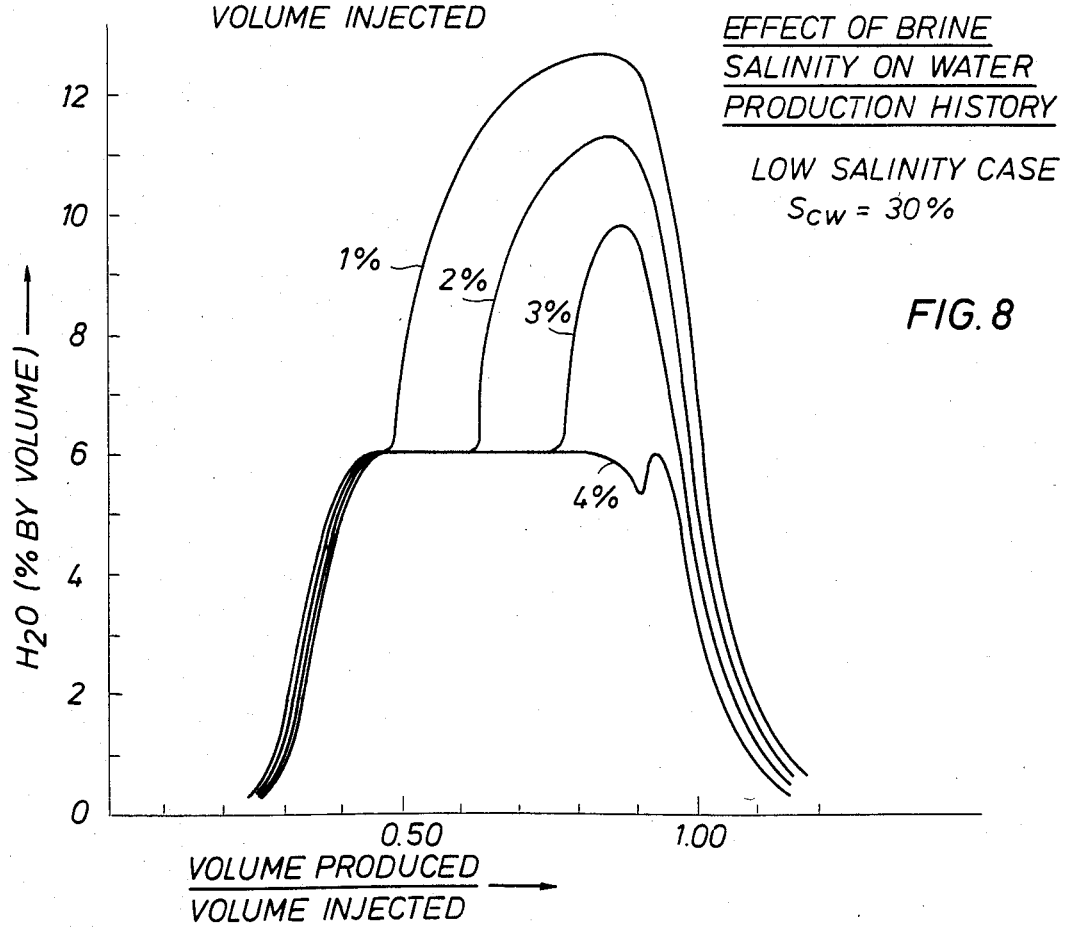
FIG. 8 is a plot demonstrating that the hump-type deviation from the water peak increases as reservoir brine salinity decreases for low salinity reservoirs.

The arrival time of the water peak is affected by the connate water saturation and salinity as in the higher salinity cases. These effects on production behavior in low salinity cases are depicted in FIGS. 7 and 8. FIG. 7 depicts the theoretical plots of three tests in theoretical reservoirs varying only in their connate water saturation. FIG. 8 depicts the theoretical plots of four tests in theoretical reservoirs varying only in the degree of their brine salinity. The reservoirs of concern in both FIGS. 7 and 8 contained light diesel oil and low salinity brine. The injected fluid was n-butanol. The reservoir temperature and pressure were 25° C. and 1 Atm. respectively.

FIGS. 7 and 8 are only examples of the hump-type deviation from the plateau behavior for the specific system mentioned: diesel oil, n-butanol, water, and sodium chloride at 25° C. and 1 Atm. The hump-type deviation from the plateau behavior can be obtained over a wider or different salinity range with the use of a different injection fluid. Different injection fluids will display differing ranges of salinity over which this hump-type deviation effect is observed. This could be seen with injection of a four-carbon alcohol other than n-butanol in a diesel oil-containing reservoir at 25° C., 1 Atm. Also, we have discovered that injection of a slightly wet alcohol will tend to extend the salinity range over which the hump-type deviation effect may be observed. The use of an injection fluid which displays a smaller water solubility would increase the sensitivity of the test to connate water saturation in those instances in which the reservoir is expected to have very low connate water saturations. Plot c in FIG. 4 depicts the test results which indicate such an injection fluid with a smaller water solubility might have been needed. Test plots like Plot c in FIG. 4 are seen when there is very low connate water saturation in the reservoir or when there is a great amount of dispersive mixing encountered in the reservoir during the test. (Such dispersive mixing may be decreased by lowering the injection rate of the fluid into the reservoir.) Plot c shows that oil breakthrough occurs in these causes before the effluent water concentration reaches the plateau or salt-saturated value.

The preferred test design in this invention will include the choice of a fluid for injection that will cause a hump-type deviation from the plateau behavior during production and thereby enable determination of both the connate water saturation and salinity from the test.

Figure 11:
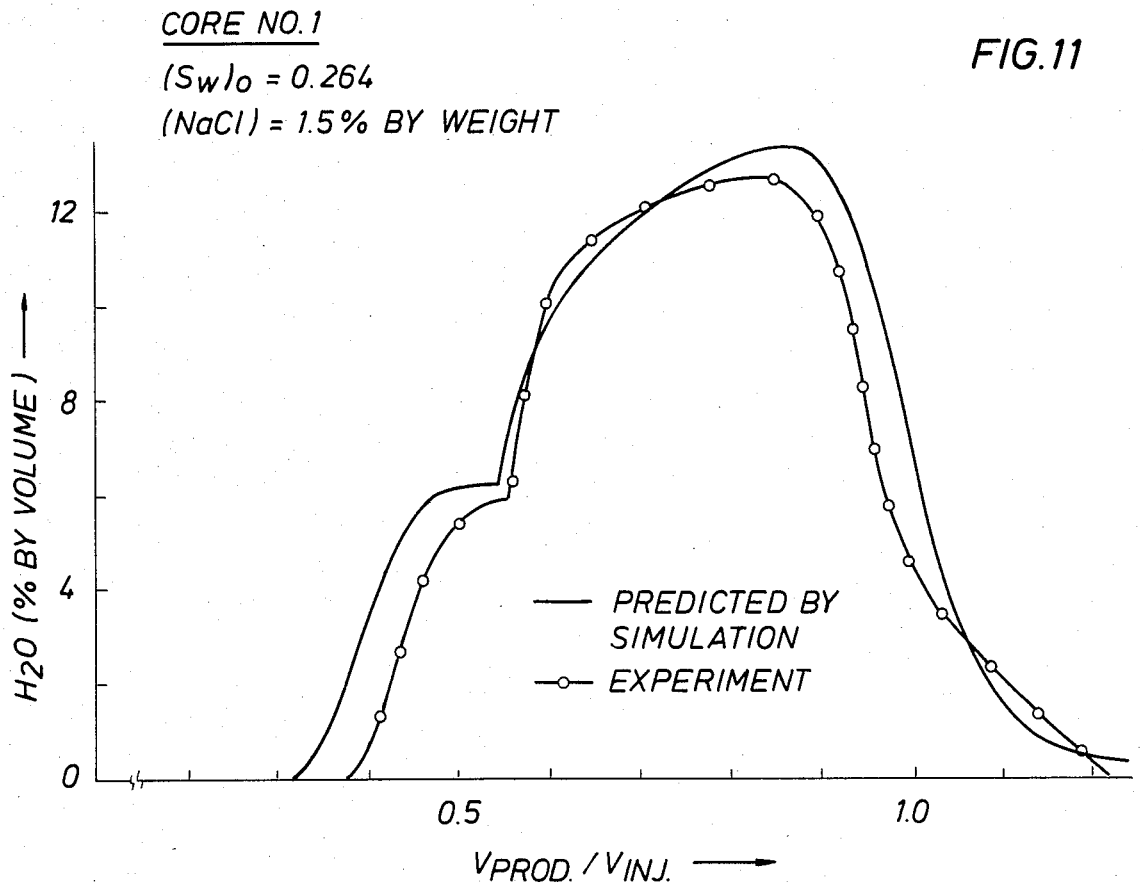
FIG. 11 is a graph which compares experimental data for the lower salinity core of FIG. 9 with the data predicted by computer simulation.
Figure 12:
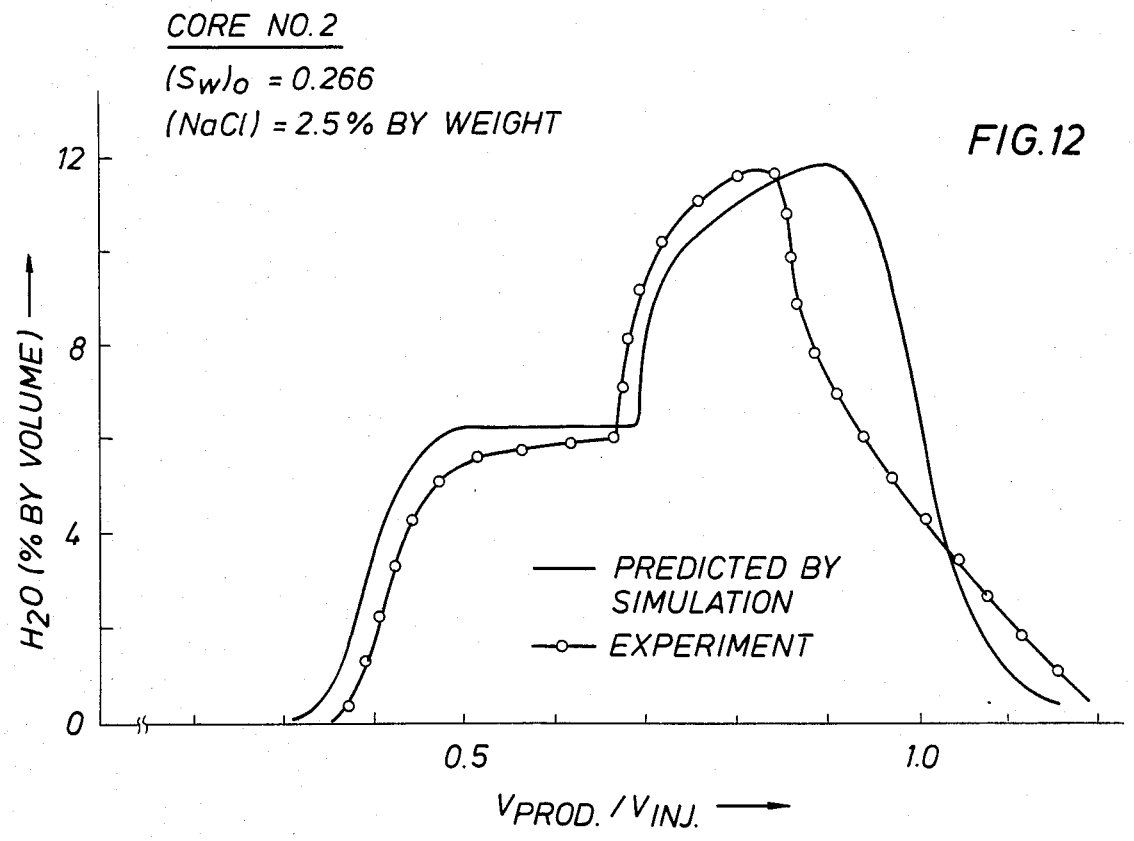
FIG. 12 is a graph which compares experimental data for the higher salinity core of FIG. 9, said salinity still being a low salinity, with the data predicted by computer simulation. This plot shows an early bend in the tail of the water peak indicating some early oil breakthrough occurred in the experiment.
Figure 13:
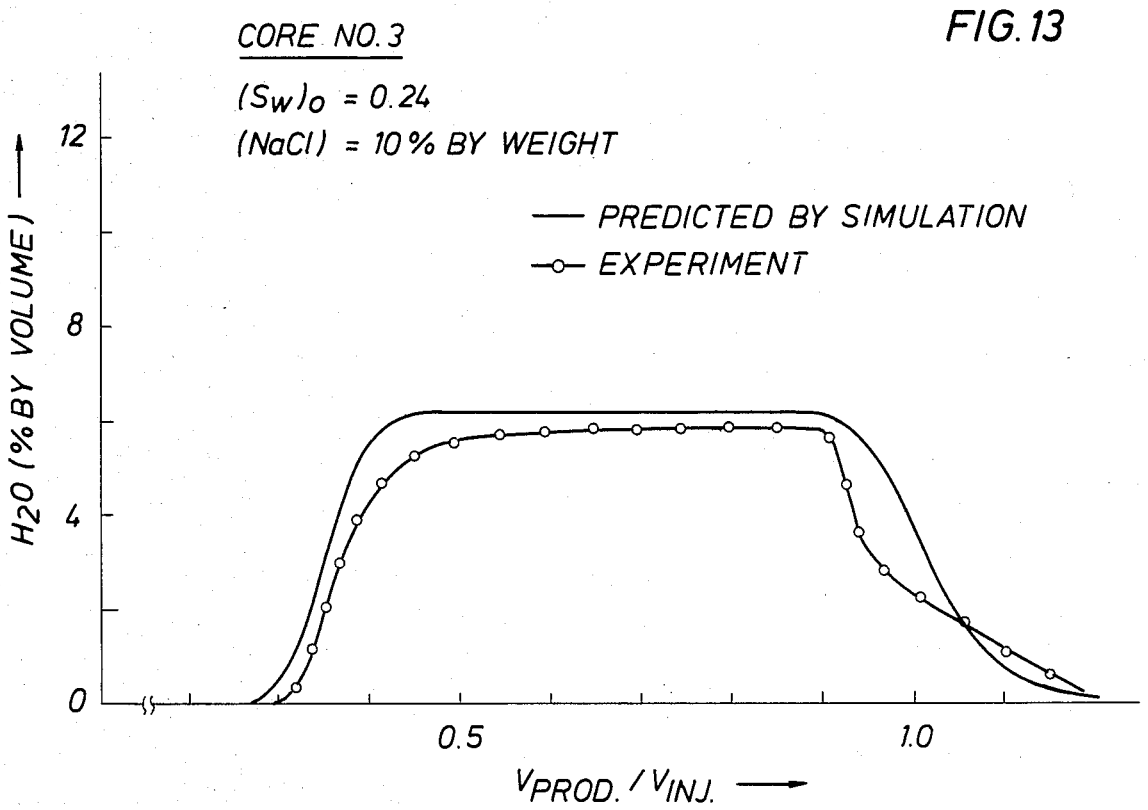
FIG. 13 is a graph which compares experimental data for a high salinity core with the data predicted by computer simulation.

To develop mathematically simulated curves for comparison with plotted test results, such as those depicted in FIGS. 11, 12 and 13, component volume valance equations should be solved. This may be done by hand or with a computer using a compositional computer simulation program which describes multiphase, multi-component flow in a porous medium. The basic component material balance equation used contains terms for accumulation, convective flow, and dispersion. With the assumption that the partial molar volumes of each component are constant, the material balance equation can be expressed in terms of volume as follows:

$$\phi \frac{\partial}{\partial t}(C_{si}) + U_T \frac{1}{r} \frac{\partial}{\partial r}[r \cdot C_{fi}] =$$

$$D_E \cdot \frac{1}{r} \frac{\partial}{\partial r}\left(r \frac{\partial C_{fi}}{\partial r}\right) \quad i = 1,2,3, \ldots NC$$

where: $C_{si} = \sum_{j=1}^{NP} x_{ij}s_j$ for $i = 1,2,3, \ldots NC$ $$C_{fi} = \sum_{j=1}^{NP} x_{ij}f_j \text{ for } i = 1,2,3, \ldots NC$$

$$\sum_{i=1}^{NC} C_{si} = 1$$

$$\sum_{i=1}^{NC} C_{fi} = 1$$

i=component reference number, the components usually being injected fluid, water, oil and salt j=phase reference number, the phases usually being oil and water $x_{ij}$=volume fraction of component "i" in "j" phase $s_j$=saturation of "j" phase $f_j = U_j/U_T$=fractional flow of "j" phase $U_T = U_{oil} + U_{water}$=total superficial velocity of fluids, where such fluids are usually oil and water $\Phi$=porosity NC=number of components NP=number of phases (usually oil and water)

$D_E$=effective dispersion coefficient

The application of this equation in developing a simulation model (by hand or by computer) will be understood to one skilled in the art, as will be the development of this equation itself. Equilibrium data describing the interaction of the injected fluid with the water, salt and oil present in the reservoir test area at reservoir conditions is necessary as input to the simulation model. Some assumed fractional flow behavior is also required as input, but the results are not usually sensitive to these data. Boundary conditions for the simulation model are set to match the conditions present during the actual test—flowrates as a function of time and composition of injected fluid. A guess is made as to the connate water saturation and salinity present in he reservoir. These are used to calculate the component pore space compositions which represent the initial conditions necessary for the finite difference calculation. The simulation model is then used to generate a plot either by hand or by computer of the water content of the produced fluids as a function of produced volume which is then compared to the test data. Said guess may be later improved by trial and error to generate curves more closely corresponding to the test plot. The values for saturation and salinity used in the simulation that generated the curve matching the test plot will be the same as the connate water saturation and salinity values for the tested reservoir.

It is believed that one skilled in the art could develop a simulator program for generating comparison curves for use in the practice of this invention. Hence, further discussion of the simulator program need not be given here. However, for such further discussion, see inventor A. D. Mut's In Situ Experimental Determination of Resident Water Saturation and Brine Salinity in a Petroleum Reservoir (Masters Thesis, Rice University, May 1982). For a general discussion of developing compositional computer simulation programs, see S. M. Farouq Ali and C. D. Stahl, Computer Models for Simulating Alcohol Displacement in Porous Media, Society of Petroleum Engineers Journal (March, 1965).

EXPERIMENTAL

Laboratory experiments have been performed to test the application of this invention for determining the in-situ saturation and the salinity of the connate water in an oil-bearing reservoir. Several experiments were performed on 1½ inch diameter, Berea sandstone cores which were 36 inches in length. The cores had porosities of about 25% and permeabilities from 500 to 1000 md. The cores were confined in triaxial core mounting pressure cells for laboratory core floods. The cores were evacuated and subsequently saturated with brines of known salinities. The water saturation was then reduced to the irreducible value by flooding with Primol 355 (180 cp.), a viscous white oil. This oil was in turn displaced with four pore volumes of diesel oil. A volume of dry n-butyl alcohol which approximated the volume of oil in the core was injected in each core. Flow was then reversed and the effluent was analyzed for water content by the Karl Ficher titration technique.

Figure 9:
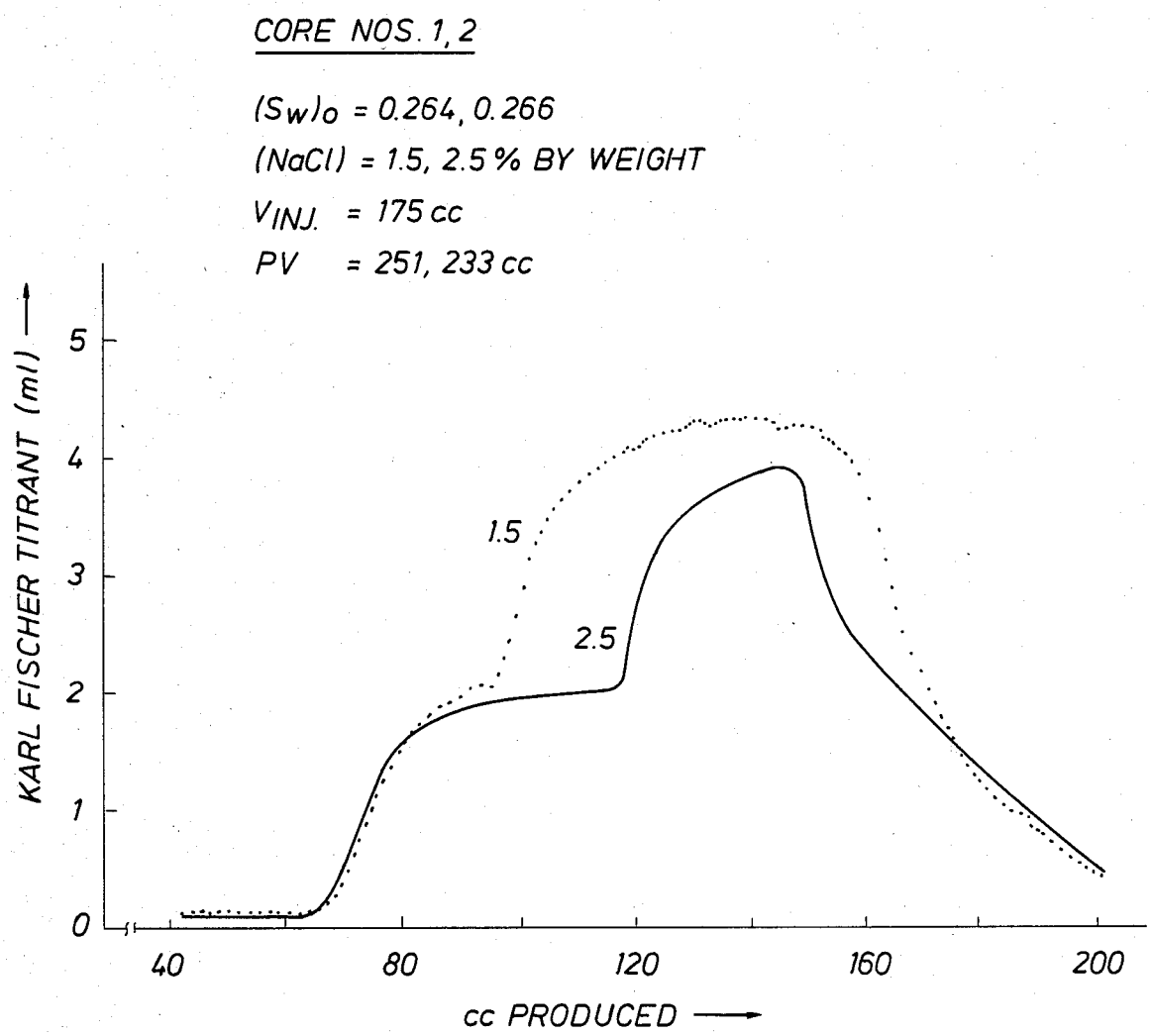
FIG. 9 is a plot showing experimental data for two cores with approximately equal initial water saturations but different brine salinities.

Representative production data from two of the cores is plotted in FIG. 9. Those two cores had approximately equal initial water saturations but different brine salinities. The salinities were both in the low range (with respect to the n-butanol, oil and brine system), however, so a hump-type deviation from the plateau was seen in the water peak. This plot demonstrates the sensitivity of the production behavior to reservoir brine salinity. The slightly earlier arrival time seen with the core containing the higher salinity (2½% by weight sodium chloride) brine was as expected—peak water arrival time becoming sooner with increasing salinity.

Figure 10:
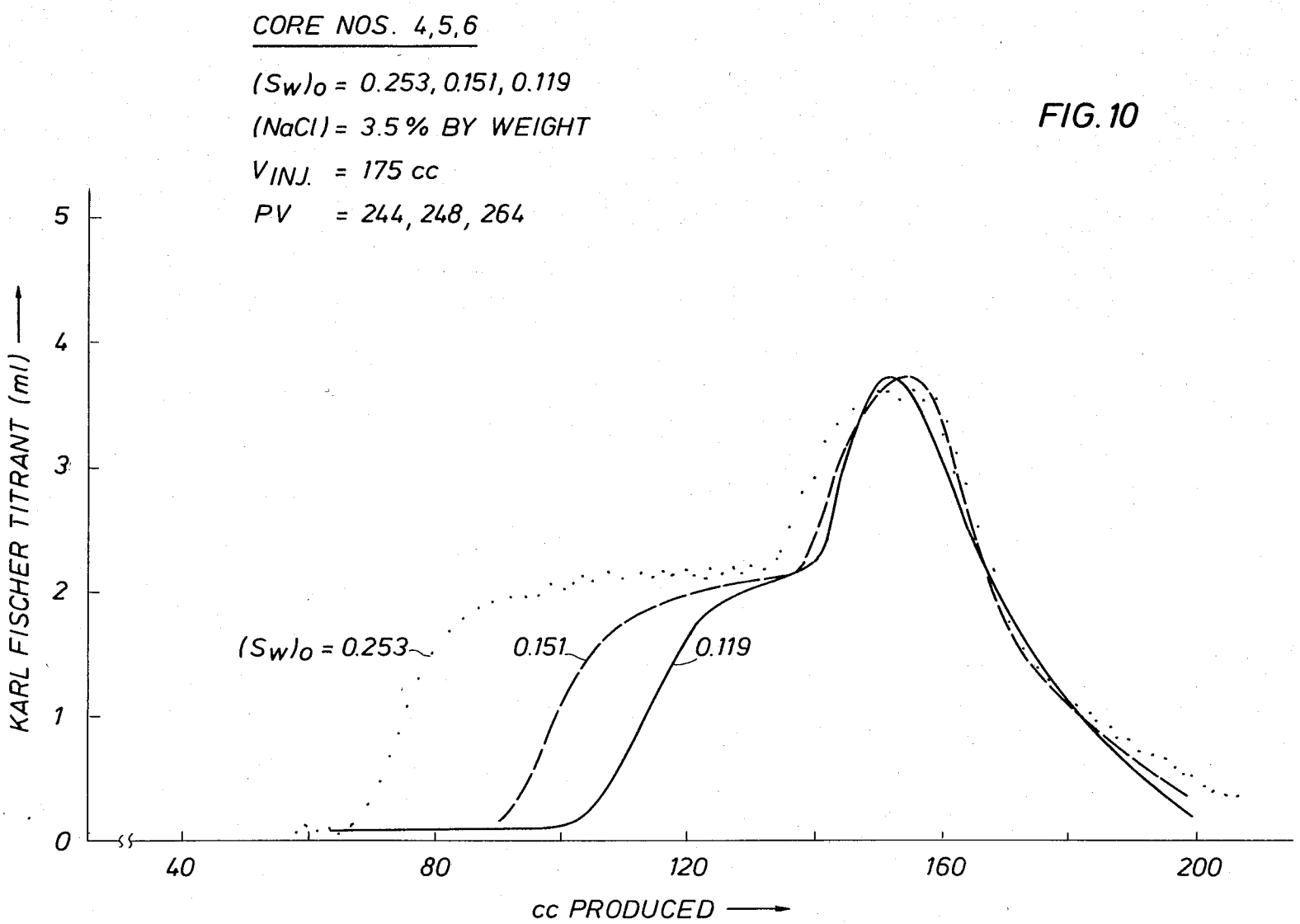
FIG. 10 is a plot showing experimental data for three cores with approximately equal initial brine salinities but different connate water saturations.

Representative production data from three other cores is plotted in FIG. 10. Those three cores had approximately equal brine salinities but different initial water saturations. The salinities were again in the low range with respect to the n-butanol, oil and brine system (about 3.5% by weight sodium chloride), however, so a hump-type deviation from the plateau was seen in the water peak. This plot demonstrates the significant effect of reservoir connate water saturation on the peak water arrival time.

FIGS. 11 and 12 depict the data from the two cores of FIG. 9 again, but this time separately with a comparative computer simulated curve for each core. Production data from a core tested containing brine of high salinity relative to the n-butanol for the oil and brine is depicted in FIG. 13 along with a simulated plot for that core. As expected with a high salinity core, no hump-type deviation from the water peak was seen.

FIGS. 11, 12 and 13 all show good agreement between experimentally observed peak and plateau heights with those predicted by computer simulation. FIGS. 11 and 12 also show good agreement between the experimentally observed arrival times of the deviations from the plateau production behavior with those predicted by computer simulation. There is a discrepancy between the experimentally observed and computer simulation predicted trailing edges in FIG. 12 indicating oil breakthrough occurred prematurely in that experiment. This effect is probably due to the volume of n-butanol injected into this core being higher than the oil present in the core originally so that mixing of the water-bearing n-butanol with oil outside the pore space of the core may have occurred.

The observed water peak arrival times for all three experiments depicted in FIGS. 11, 12 and 13 were late compared to such times predicted by computer simulation. The discrepancy lessens, however, as the brine salinity increases. This discrepancy is believed to be due to an inaccuracy in the computer simulation model describing the equilibrium behavior of the diesel oil, n-butanol, water and sodium chloride system. This emphasizes the need for precise equilibrium data concerning the selected fluid for injection with the reservoir oil and brine for proper analysis of the production behavior. Nevertheless, the excellent qualitative agreement and good quantitative agreement of the experimental data with the simulated data confirm the workability of this invention.

Displacing reservoir oil with an injected fluid as above described is part of but one embodiment of this invention. In another embodiment, the reservoir oil is displaced output of the reservoir test area prior to injection of the test fluid. Said reservoir oil displacement is accomplished by injecting into the reservoir an oil or oleic fluid miscible with the reservoir oil and for which the equilibrium properties or phase behavior in relation to the test fluid to be injected and the reservoir brine are well known or can be easily determined. The solubility of water in this oil or oleic fluid should be negligible, and the oil or oleic fluid should be miscible with the test fluid to be injected. Such test fluid will be like that injected fluid described in the embodiment above (except that it should be miscible with the previously injected oil or oleic fluid). Since the previously injected oil or oleic fluid will occupy the reservoir test area previously occupied by the reservoir oil, it will not matter whether the test fluid is miscible with the reservoir oil (although such miscibility may be likely). As in the first embodiment described above, the test fluid injected in this embodiment will also have limited ability to dissolve water and the solubility of the water in the fluid will depend on the salinity of the water. This embodiment eliminates the need to determine the phase equilibrium characteristics for each reservoir tested. It also eliminates the possibility of the formation of a separate injected fluid phase which can occur when an injected fluid such as alcohol contacts a heavy oil-brine system. In this embodiment, after the initial displacement and replacement of the reservoir oil in the test area of the reservoir, the test is basically conducted as described for the first embodiment described above.

In another embodiment of this invention, a small immobile gas phase may be present in the reservoir area to be tested along with the reservoir oil and brine. Appropriate corrections are made to account for the loss of the injected material to the gaseous phase and the test is otherwise conducted as above described for the preferred embodiment. However, such a test would only indicate the relative proportions of the two liquid phases.

Figure 14:
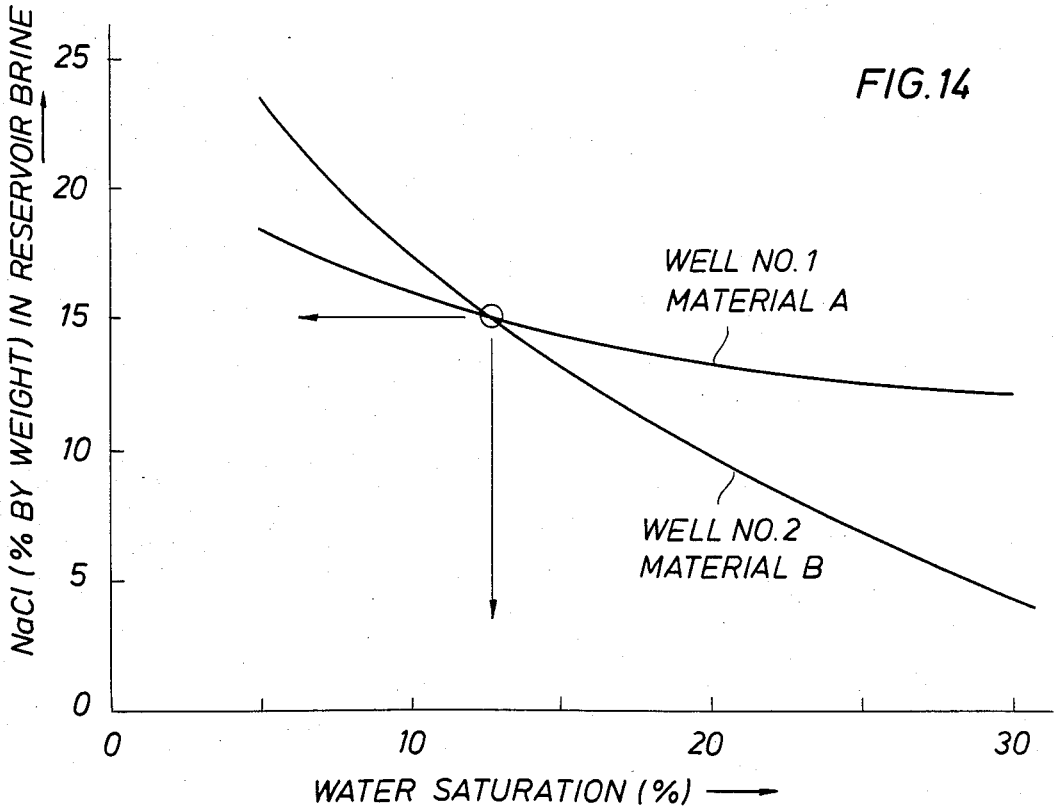
FIG. 14 is a graph which shows the intersection of two relations of saturation with respect to salinity resulting from a twowall test to determine both connate water saturation and salinity in a high salinity reservoir.

In still another embodiment of this invention, both the connate water saturation and the connate water or brine salinity may be determined in cases where the brine salinity is high (relative to the equilibrium behavior of the injected fluid with respect to the brine and the reservoir oil) by performing a two-well test. As previously mentioned, in such high salinity cases, no hump-type deviation from the flat-topped peak is observed for a single-well test. Since both water saturation and salinity affect the arrival time of the peak in a similar fashion, it is impossible to distinguish between the effects of either from a single-well test. With this embodiment, separate, single-well injection-production tests (as described above for the first embodiment) are performed on two separate wells instead of the preferred one well. The wells should be in close proximity, not more than about one-quarter mile apart, and the corresponding interval in the target formation should be tested in both wells, to insure that rock characteristics and fluid saturations are as closely related as possible. A different injection fluid should be used for each well, and the two injection fluids should display different equilibrium behavior with respect to the oil-water-salt system. Simulation of each test will indicate a relation describing the possible combinations of saturation and salinity consistent with the observed water production profile for that test. The intersection of these two relations represents the unique solution for the connate water saturation and brine salinity. The curves in FIG. 14 represent such relations of saturation and salinity consistent with the observed water peak arrival time for two hypothetical tests performed on separate wells in the same reservoir using different injected fluids. More than one intersection point could possibly occur for certain combinations of injected fluids, or if the same fluid were used for both tests. This problem can be avoided by using two injection fluids whose equilibrium behavior is such that multiple intersections of the saturation-salinity relations would not occur.

In yet another embodiment of this invention, both the connate water saturation and the connate water or brine salinity may be determined in cases where the brine salinity is high by conducting two consecutive well tests on the same test interval of the reservoir from the same wellbore. With this embodiment, different injection fluids displaying different equilibrium phase behavior are used in the two tests. The tests are conducted as described above for the first embodiment. The second test may be begun after oil breakthrough is complete on the first test. It may be preferable, however, to analyze the produced fluid samples from the first test for water content and plot the data as a function of the volume of fluids produced before proceeding with the second test. If the plot shows a hump-type deviation from a plateau-type water peak, a second test is not needed as the brine salinity was in fact low for the system and the connate water saturation and salinity may be determined as described above for the first embodiment. If the plot shows a plateau-type water peak, the second test should proceed, and the results of the first test, the plateau-type test plot, will be matched with mathematically simulated curves. A curve may then be generated describing the relation of the possible combinations of saturation and salinity consistent with the observed arrivel time of the water peak from the first test. After a plot of the water content vs. produced fluids from the second test is obtained, the water peak again appearing as a plateau-type peak, this second plot is compared to mathematically simulated curves. These latter curves are generated using the combination saturation and salinity values from the above mentioned relation curve as initial conditions for the simulation. One of the combination saturation and salinity values (which values as previously stated are all consistent with the observed arrival time of the water peak in the first test) will also be consistent with the observed arrival time of the water peak in the second test. This combination of saturation and salinity values will be the same as that for the reservoir. This simulation will model both the first and second tests to account for the fact that saturations existing in the formation are altered by the first test.

The principle of the invention and the best mode in which it is contemplated to apply have been described. It is to be understood that the foregoing is illustrative only and that other means and techniques can be employed without departing from the true scope of the invention defined in the following claims.

We claim:

1. A method for determining the connate water saturation and salinity of an oil-bearing reservoir penetrated by a wellbore comprising:

(a) injecting a known volume of fluid into said reservoir through said wellbore wherein said fluid is miscible with said oil and has the ability to dissolve a limited amount of said water and wherein the solubility of said water in said fluid depends on the salinity of said water;

(b) producing said wellbore while taking samples of the produced fluids until oil breakthrough occurs;

(c) analyzing the water content of said samples;

(d) plotting the data from said analyzation as a function of the volume of produced fluids, said plot showing a hump-type deviation from a plateau-type water peak; and (e) comparing said plot to mathematically-simulated type curves having known saturation and salinity values.

2. The method of claim 1 wherein said fluid is an oleic fluid.

3. The method of claim 1 wherein said fluid is an alcohol.

4. The method of claim 1 wherein said fluid has a viscosity similar to that of said oil.

5. A method for determining the connate water saturation and salinity of an oil-bearing reservoir at or near connate water saturation conditions and penetrated by a wellbore comprising:

(a) selecting a fluid miscible with said oil, having the ability to dissolve a limited amount of said water, wherein the solubility of said water in said fluid depends on the salinity of said water, and said salinity is thought to be low relative to the equilibrium behavior of said fluid with respect to said oil and said water;

(b) injecting a known volume of said fluid into said reservoir through said wellbore;

(c) producing said wellbore while taking samples of said produced fluids until oil breakthrough occurs;

(d) analyzing the water content of said samples;

(e) plotting the data from said analyzation as a function of the volume of produced fluids; and (f) comparing said plot to similar curves generated by mathematically-simulated type curves having known saturation and salinity values.

6. A method for determining the connate water saturation and salinity of an oil-bearing reservoir penetrated by a wellbore comprising:

(a) selecting two different oleic fluids, the first oleic fluid being miscible with said reservoir oil and the solubility of said water in said first oleic fluid being negligible, the second oleic fluid being miscible with said first oleic fluid and the solubility of said water in said second oleic fluid being dependent on the salinity of said water, said second oleic fluid having a limited ability to dissolve said water and the equilibrium properties of said second fluid in relation to said first fluid and said water being known;

(b) displacing said oil near said wellbore with said first oleic fluid by injecting said first oleic fluid into said reservoir through said wellbore;

(c) injecting a known volume of said second oleic fluid into said reservoir through said wellbore;

(d) producing fluids from said wellbore while taking samples of said fluids until oil breakthrough occurs;

(e) analyzing the water content of said sample;

(f) plotting the data from said analyzation as a function of the volume of produced fluids, said plot showing a hump-type deviation from a plateau-type water peak; and (g) comparing said plot to mathematically-simulated type curves having known saturation and salinity values.

7. A method for determining the connate water saturation of an oil-bearing reservoir penetrated by a wellbore comprising:

(a) selecting a fluid miscible with said oil, having the ability to dissolve a limited amount of said water, wherein the solubility of said water in said fluid depends on the salinity of said water, and said salinity is known and is high relative to the equilibrium behavior of said fluid with respect to said oil and said water;

(b) injecting a known volume of said fluid into said reservoir through said wellbore;

(c) producing said wellbore while taking samples of said produced fluids until oil breakthrough occurs;

(d) analyzing the water content of said samples;

(e) plotting the data from said analyzation as a function of the volume of produced fluids; and (f) comparing said plot to mathematically-simulated type curves having known saturation and salinity values.

8. A method for determining the connate water salinity in an oil-bearing reservoir penetrated by a wellbore and at connate water saturation conditions where the connate water saturation is known comprising:

(a) selecting a fluid miscible with said oil, having the ability to dissolve a limited amount of said water, wherein the solubility of said water depends on the salinity of said water;

(b) injecting a known volume of said fluid into said reservoir through said wellbore;

(c) producing said wellbore while taking samples of said produced fluids until oil breakthrough occurs;

(d) analyzing the water contents of said samples;

(e) plotting the data from said analyzation as a function of the volume of produced fluids, said plot showing a plateau-type water peak; and (f) comparing said plot to mathematically-simulated type curves having known saturation and salinity values.

9. A method for determining the connate water saturation and salinity of an oil-bearing reservoir at connate water saturation conditions and penetrated by two closely spaced wellbores comprising:

(a) selecting two different fluids miscible with said oil, each having different abilities to dissolve a limited amount of said water and the solubility of said water in each being dependent on the salinity of said water;

(b) injecting a known volume of one of said fluids in one of said wallbores and injecting a known volume of the other of said fluids in the other of said wellbores;

(c) producing said wellbores while taking samples of said produced fluids until oil breakthrough occurs in each well;

(d) analyzing the water content of said samples;

(e) plotting the data from said analyzation for each well as a function of the volume of produced fluids for that well, said plots both showing a plateau-type water peak;

(f) comparing said plots to mathematically-simulated type curves having known saturation and salinity values, said value for said type curves which match said plots indicating a relation for each plot describing the possible combinations of said water saturation and said water salinity consistent with that plot; and (g) determining the intersection of said two relations.

10. A method for determining the connate water saturation and salinity of an oil-bearing reservoir at connate water saturation conditions and penetrated by a wellbore comprising:

(a) selecting two different fluids miscible with said oil, having the ability to dissolve a limited amount of said water wherein the solubility of said water depends on the salinity of said water, and displaying different equilibrium phase behavior with respect to said oil and said water;

(b) injecting a known volume of one of said fluids in said wellbore;

(c) producing said wellbore while taking samples of said produced fluids until oil breakthrough is complete in said wellbore;

(d) analyzing the water content of said samples;

(e) plotting the data from said analyzation as a function of the volume of produced fluids, said plot showing a plateau-type water peak;

(f) repeating steps (b) through (e) with said other fluid;

(g) generating mathematically-simulated type curves having known saturation and salinity values, said values for said type curves which match said first plot indicating a relation for said first plot describing the possible combinations of said water saturation and said water salinity consistent with said first plot;

(h) generating type curves by mathematical simulation using said relation values describing possible combinations of said water saturation and said water salinity consistent with said first plot as initial conditions for said simulation, the one of said curves that matches said second plot indicating the values of the reservoir connate water saturation and salinity.

11. A method for determining the connate water saturation and salinity of an oil-bearing reservoir at connate water saturation conditions and penetrated by a wellbore comprising:

(a) selecting an oleic fluid miscible with said oil, having a viscosity similar to that of said oil, having the ability to dissolve a limited amount of said water and wherein the solubility of said water in said oleic fluid depends on the salinity of said water;

(b) injecting a known volume of said oleic fluid into said reservoir through said wellbore at a rate sufficiently slow to allow said oleic fluid to reach equilibrium with said water and to minimize dispersion of said oleic fluid in said reservoir;

(c) completely extracting said water in said reservoir near said wellbore with said oleic fluid, and precipitating salt from said extracted water in said reservoir near said wellbore;

(d) displacing said oil into said reservoir away from said wellbore with said oleic fluid containing said extracted water dissolved therein;

(e) producing fluids from said well bore while taking samples of said fluids until oil breakthrough occurs;

(f) analyzing the water content of said samples;

(g) plotting the data from said analyzation as a function of the volume of produced fluids, said plot showing a hump-type deviation from a plateau-type water peak; and (h) comparing said plot to similar curves generated by a simulator computer program, said similar curves having known saturation and salinity values.

* * * * *